US011297696B2

(12) United States Patent
Lee et al.

(10) Patent No.: US 11,297,696 B2
(45) Date of Patent: Apr. 5, 2022

(54) MICROWAVE OVEN HAVING HOOD

(71) Applicant: LG Electronics Inc., Seoul (KR)

(72) Inventors: Sangcheol Lee, Seoul (KR); Kyoungjoon Park, Seoul (KR); Jaekyung Yang, Seoul (KR); Wontae Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/905,511

(22) Filed: Jun. 18, 2020

(65) Prior Publication Data

US 2021/0289593 A1 Sep. 16, 2021

(30) Foreign Application Priority Data

Mar. 16, 2020 (KR) ..... 10-2020-0032254

(51) Int. Cl.
*H05B 6/64* (2006.01)
*F24C 15/20* (2006.01)

(52) U.S. Cl.
CPC ..... *H05B 6/6423* (2013.01); *F24C 15/2071* (2013.01)

(58) Field of Classification Search
CPC ..... H05B 6/642; H05B 6/645; H05B 6/6405; H05B 6/6423; H05B 6/6426; H05B 6/6429; H05B 6/6435; H05B 6/6447; H05B 6/6461; H05B 6/6473; H05B 6/6485; H05B 6/668; F24C 15/006; F24C 15/008; F24C 15/02; F24C 15/023; F24C 15/024; F24C 15/028; F24C 15/04; F24C 15/20; F24C 15/2021; F24C 15/2028; F24C 15/2042; F24C 15/2064; F24C 15/2071
USPC ..... 219/739, 740, 756, 757
See application file for complete search history.

(56) References Cited

U.S. PATENT DOCUMENTS

| | | | | |
|---|---|---|---|---|
| 6,621,058 | B1 | 9/2003 | Kim | |
| 2005/0224068 | A1* | 10/2005 | Kim | F24C 15/006 126/198 |
| 2007/0158330 | A1 | 7/2007 | Kim et al. | |
| 2010/0181308 | A1 | 7/2010 | Lee | |
| 2019/0261459 | A1 | 8/2019 | Cha et al. | |
| 2020/0025389 | A1* | 1/2020 | Erbe | F24C 7/085 |
| 2020/0217514 | A1* | 7/2020 | Clayton | F24C 7/086 |
| 2021/0102707 | A1* | 4/2021 | Park | H05B 6/062 |

FOREIGN PATENT DOCUMENTS

| | | |
|---|---|---|
| EP | 1365630 | 11/2003 |
| KR | 100628081 | 9/2006 |
| KR | 100705098 | 4/2007 |

OTHER PUBLICATIONS

PCT International Search Report and Written Opinion in International Appln. No. PCT/KR2020/004970, dated Dec. 3, 2020, 9 pages.

* cited by examiner

*Primary Examiner* — Hung D Nguyen
(74) *Attorney, Agent, or Firm* — Fish & Richardson P.C.

(57) ABSTRACT

A microwave oven includes a housing that defines a cavity therein, a heating source configured to heat an object in the cavity, an exhaust device disposed at a lower portion of the housing, a door that is connected to the housing and defines a suction hole configured to receive air from an outside of the door and a discharge hole configured to discharge the air received through the suction hole, and a display disposed at a front surface of the door.

20 Claims, 6 Drawing Sheets

MICROWAVE OVEN HAVING HOOD

CROSS-REFERENCE TO RELATED APPLICATIONS

This application claims priority under 35 U.S.C. 119 and 365 to Korean Patent Application No. 10-2020-0032254, filed on Mar. 16, 2020, the disclosure of which is incorporated herein by reference.

TECHNICAL FIELD

The present disclosure relates to a microwave oven having a hood.

BACKGROUND

A microwave oven may include a hood installed above a gas stove in a kitchen and configured to absorb and discharge contaminated air generated in cooking food on the gas stove. In some examples, the hood may be combined with a microwave oven. The microwave oven may be able to perform functions of two household appliances through one device, but an inner space of the microwave oven may be narrow in some cases.

In some examples, the microwave oven may include a display and a separate cooling space or device for dissipating heat generated in the display. In some cases, the cooling space may be limited, and the display may be contaminated by the contaminated air flowing upward from a lower side of the oven. Therefore, it may be difficult to maintain cleanliness of the microwave oven.

SUMMARY

According to one aspect of the subject matter described in this application, a microwave oven includes a housing that defines a cavity therein, a heating source configured to heat an object in the cavity, an exhaust device disposed at a lower portion of the housing, a door that is connected to the housing and defines a suction hole configured to receive air from an outside of the door and a discharge hole configured to discharge the air received through the suction hole, and a display disposed at a front surface of the door.

Implementations according to this aspect may include one or more of the following features. For example, the microwave oven may further include a cooling fan disposed at an inner surface of the door and configured to blow the air toward the discharge hole. In some examples, the discharge hole may be defined vertically below the suction hole. In some examples, the discharge hole may be defined vertically below the display. In some examples, the door may be configured to guide the air received through the suction hole, and the discharge hole may be configured to discharge the air guided along a direction parallel to the front surface of the door.

In some implementations, the discharge hole may be defined vertically above the display. In some examples, the discharge hole may be configured to guide the air toward the display.

In some implementations, the discharge hole may be defined at a bottom surface of the door. In some examples, the discharge hole may be configured to guide the air to a lower side of the door. In some examples, the microwave oven may further include a camera disposed around the discharge hole and configured to photograph a lower side of the housing.

In some implementations, the microwave oven may include a camera disposed at an inner surface of the door. In some implementations, the microwave oven may include a camera disposed at the front surface of the door.

In some implementations, the discharge hole may include at least one of a first discharge hole defined vertically below the display, a second discharge hole defined vertically above the display, or a third discharge hole defined at a bottom surface of the door. In some examples, the door defines at least one of a first air passage configured to guide the air from the suction hole to the first discharge hole, a second air passage configured to guide the air from the suction hole to the second discharge hole, or a third air passage configured to guide the air from the suction hole to the third discharge hole.

In some implementations, the door defines a first discharge hole vertically below the display, a second discharge hole vertically above the display, and a third discharge hole at a bottom surface of the door, where the discharge hole is one of the first discharge hole, the second discharge hole, or the third discharge hole.

According to another aspect, a microwave oven includes a housing that defines a cavity therein, a heating source configured to heat an object in the cavity, an exhaust device disposed at a lower portion of the housing, a door that is connected to the housing and defines a suction hole configured to receive air and a discharge hole configured to discharge the air received through the suction hole, and a door inner wall that extends in a vertical direction and that partitions an inner space of the door into a first door passage in communication with the suction hole and a second door passage in communication with the discharge hole.

Implementations according to this aspect may include one or more of the following features. For example, the door inner wall defines a through-hole that connects the first door passage to the second door passage, and the microwave oven may further include a cooling fan disposed at the through-hole of the door inner wall and configured to supply air from the first door passage to the second door passage.

In some implementations, the microwave oven may further include a display that is positioned forward relative to the door inner wall and extends in the vertical direction. In some examples, the suction hole may be defined at an upper surface of the door, and the door may define a first discharge hole disposed vertically below the display and a second discharge hole disposed between the upper surface of the door and an upper and of the display. The discharge hole may be the first discharge hole or the second discharge hole.

In some examples, the first discharge hole may be defined at at least one of a front surface of the door that faces the display or a bottom surface of the door that faces the exhaust device.

In some implementations, a separate air passage may be provided in the door to avoid contamination of the door by the contaminated air flowing upward from the lower side facing the cooking appliance, thereby maintaining the cleanliness of the door.

In some implementations, the display may be disposed on the front surface of the door and cooled by air passing through the cooling passage within the door to dissipate the heat generated by the display.

In some examples, the user may check the recipe through the display disposed on the front surface of the door while cooking the food.

DETAILED DESCRIPTION

Figure 1:
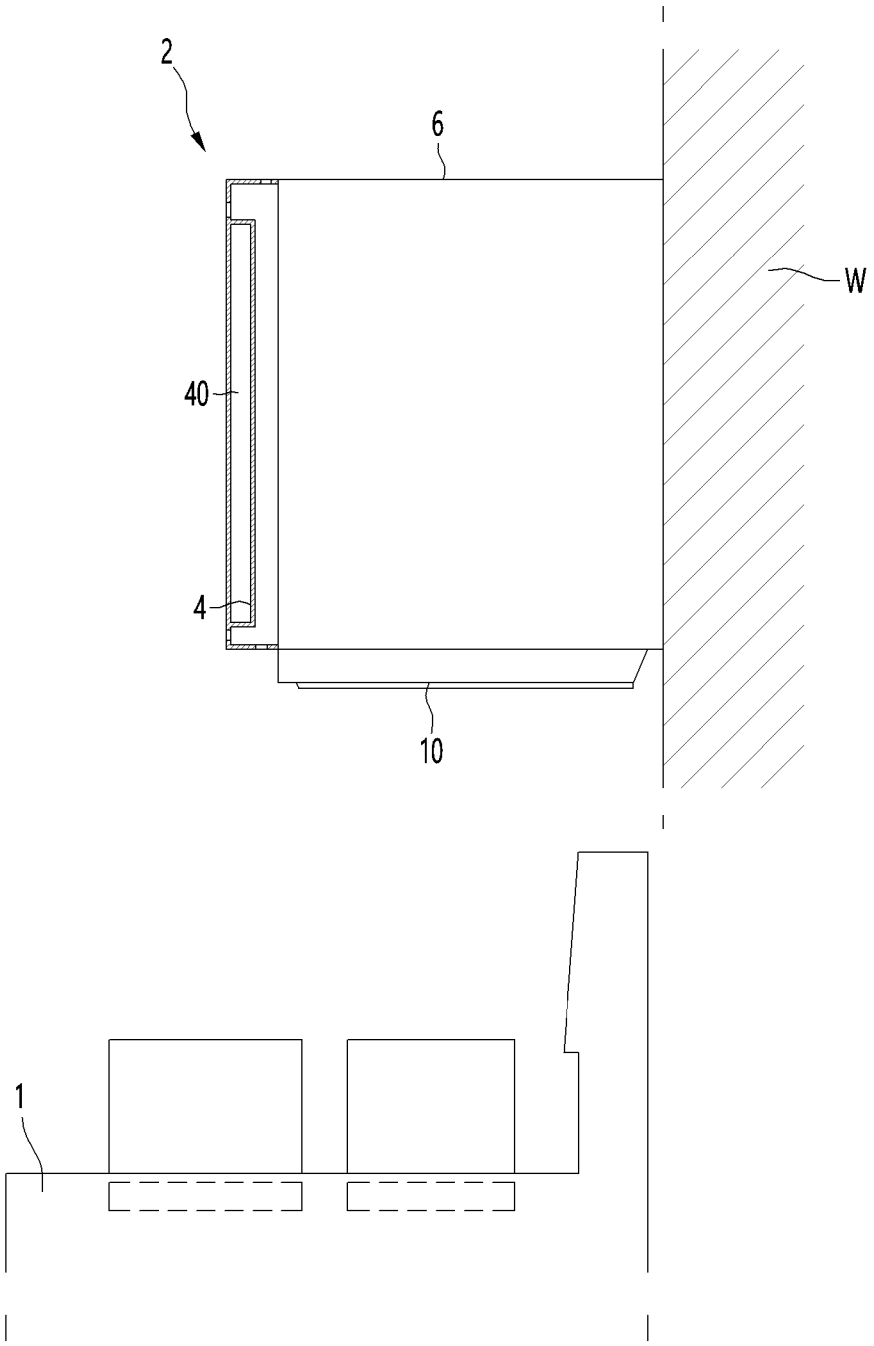
FIG. 1 is a view illustrating an example of a microwave oven having a hood disposed above an example appliance.

Hereinafter, one or more implementations of the present disclosure will be described in detail with reference to the accompanying drawings. Exemplary implementations of the present disclosure will be described below in more detail with reference to the accompanying drawings. It is noted that the same or similar components in the drawings are designated by the same reference numerals as far as possible even if they are shown in different drawings. In the following description of the present disclosure, a detailed description of known functions and configurations incorporated herein will be omitted to avoid making the subject matter of the present disclosure unclear.

FIG. 1 is a view illustrating an example of a microwave oven having a hood above an example appliance.

As illustrated in FIG. 1, a microwave oven 2 having a hood may be installed in a kitchen. For example, the microwave oven 2 may be disposed above a cooking appliance 1 configured to cook food by a user. For example, the cooking appliance 1 may include a gas stove, an induction, and the like.

The microwave oven 2 may suction and discharge contaminated air generated when the cooking appliance 1 is used. The microwave oven 2 may be installed on a wall W in the kitchen. The microwave oven 2 may include a wall-mounted exhaust device and a microwave oven.

The microwave oven 2 may include a housing 6 and a door 4 connected to the housing 6. The door 4 may be configured to open and close a cavity defined inside the housing 6 to be described later. In some examples, the microwave oven 2 may include a display 40 attached to a front surface of the door 4. The display 40 may display an image photographed by a camera module, which will be described later. In some examples, the display 40 may be provided as a touch display configured to receive a control command for controlling the microwave oven 2 through a user's touch input. The detailed description of the display 40 will be described later.

The contaminated air generated when the cooking appliance 1 is used may be absorbed into a lower portion of the housing 6 by an exhaust device 10 mounted on the lower portion of the housing 6 of the microwave oven 2, and then be discharged to the outside. In addition, the door 4 of the microwave oven 2 may be configured so that air is discharged to help to prevent the contaminated air from approaching the door 4.

An air flow inside and around the microwave oven 2 will be described with reference to FIGS. 2 and 3.

Figure 2:
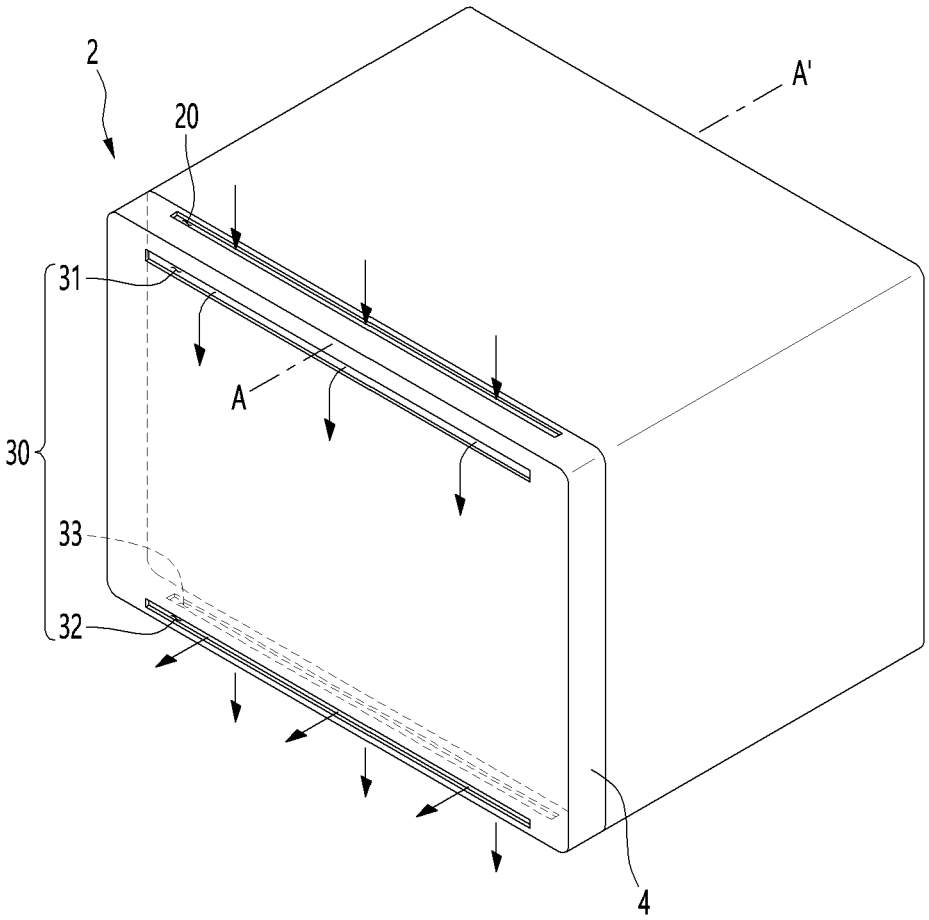
FIG. 2 is a view illustrating the microwave oven.
Figure 3:
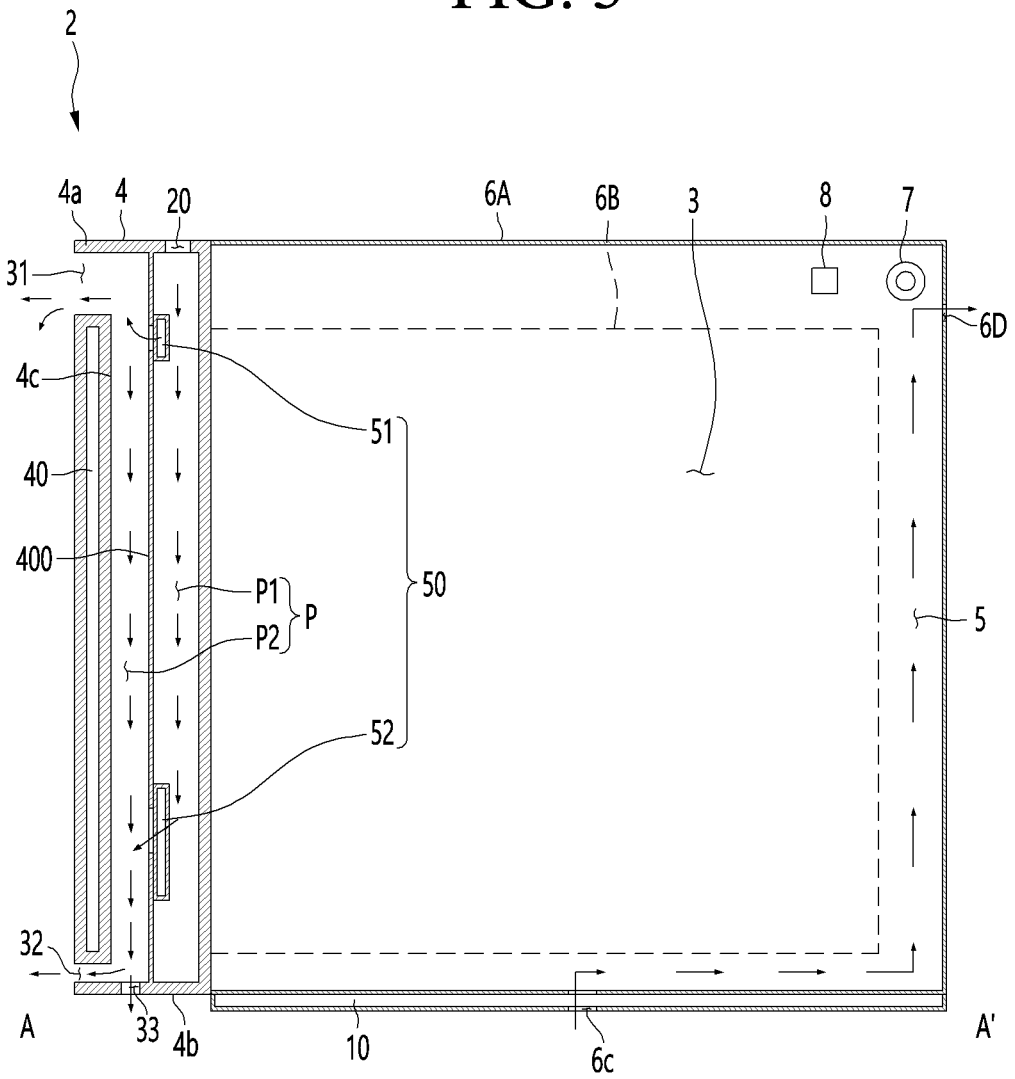
FIG. 3 is a cross-sectional view taken along line A-A' of FIG. 2.

FIG. 2 is a view illustrating the microwave oven, and FIG. 3 is a cross-sectional view taken along line A-A' of FIG. 2.

A suction hole 20 through which air is suctioned and a discharge hole 30 through which the air suctioned through the suction hole 20 is discharged may be defined in the door 4.

At least one or more discharge holes 30 may be defined in the door 4. The discharge hole 30 may include a first discharge hole 32 defined below the display 40, a second discharge hole 31 defined above the display 40, and a third discharge hole 33 defined in a bottom surface of the door 4.

An arrow illustrated in FIG. 2 illustrates a state in which external air is introduced into the door 4 through the suction hole 20, and the introduced air is discharged through each of the first discharge hole 32, the second discharge hole 31, and the third discharge hole 33.

As illustrated in FIG. 3, the housing 6 of the microwave oven 2 may include a cavity 3 into which food is accommodated and a heating source 8 providing heat to the cavity 3 so as to perform a function of the microwave oven.

The heating source 8 may provide heat to the inside of the cavity 3 to cook food accommodated in the cavity 3. The heating source 8 may include a magnetron that generates microwaves, a high-voltage transformer that applies high-voltage current to the magnetron, a capacitor, and the like.

Figure 5:
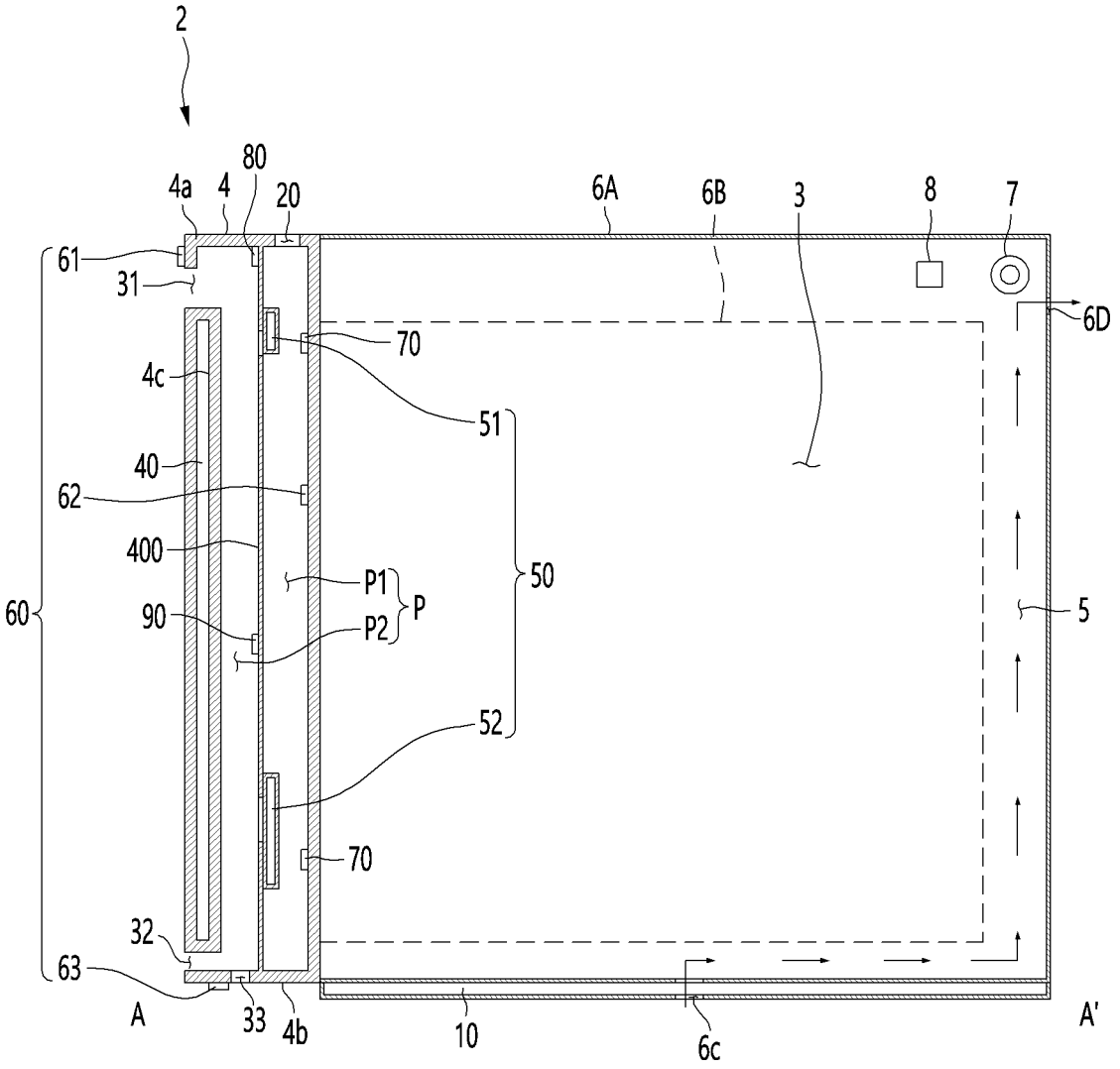
FIG. 5 is a view illustrating an example of various components of the microwave oven.

The door 4 may be provided with a microwave shielding choke 70 (see FIG. 5). The microwave shielding choke 70 may be disposed inside the door 4 to block microwaves generated from the heating source 8 and transmitted toward a module provided in the door 4 or to a user.

The microwave oven 2 may further include an exhaust passage 5 connected to the exhaust device 10 mounted on the lower portion of the housing 6 and a vent fan 7 installed on the exhaust passage 5.

The cavity 3 and the exhaust passage 5 are provided as separate spaces. That is, a cooking operation performed in the microwave oven 2 and an exhaust operation of the exhaust device 10 may be performed separately.

The housing 6 may include an outer housing 6A defining an outer appearance thereof and an inner housing 6B disposed inside the outer housing 6A and having the cavity 3 therein.

In the drawing, although the exhaust passage 5 are provided between the inner housing 6B and the outer housing 6A, the implementation is not limited thereto. For example, the exhaust passage 5 may be provided outside the outer housing 6A. The exhaust passage 5 may be partitioned from the cavity 3 inside the inner housing 6B.

A housing suction hole 6C through which external air is suctioned into the exhaust passage 5 and a housing exhaust hole 6D through which the air blown from the vent fan 7 is discharged to the outside may be defined in the housing 6.

Referring to the arrow illustrated in FIG. 3, the air suctioned by the exhaust device 10 flows along the exhaust passage 5. That is, the air suctioned into the housing suction hole 6C by the exhaust device 10 may be guided along the exhaust passage 5 and then be discharged through the housing exhaust hole 6D. In addition, the exhaust passage 5 or the housing exhaust hole 6D may communicate with an exhaust hole defined in a wall W or a ceiling to discharge the contaminated air to the outside.

Here, the cooking appliance 1 and the exhaust device 10 are merely exemplary. Thus, the microwave oven 2 may be installed in various forms in a place to be needed.

The contaminated air generated when cooking food in the cooking appliance 1 may be minimized to be adsorbed on the door 4 and may be exhausted through the exhaust device 10.

The suction hole 20 and the discharge hole 30 defined in the door 4 may be defined so that the contaminated air, generated when cooking food in the cooking appliance 1, is not accumulated to the door 4.

Hereinafter, for convenience of description, the air generated when cooking food in the cooking appliance 1 is referred to as contaminated air, and air suctioned into the door from the periphery of the door 4 is referred to as external air.

Hereinafter, an air flow in a portion of the door 4 of the microwave oven 2 will be described in detail.

The door 4 may be divided into a door top surface 4*a*, a door bottom surface 4*b*, and a door front surface 4*c*.

The suction hole 20 through which the external air is suctioned may be defined in the top surface 4*a* of the door.

The discharge hole 30 may be defined in the door bottom surface 4*b* and the door front surface 4*c*.

In some implementations, the door 4 may define a door passage P that guides the air suctioned through the suction hole 20 so as to be discharged through the discharge hole 30.

In some implementations, the door 4 may include a door inner wall 400 that divides the door passage P into a first door passage P1 and a second door passage P2, and a cooling fan 50 disposed at the door inner wall 400.

The cooling fan 50 may be a mechanical device that is capable of inducing an air flow to draw the air through the suction hole 20 and discharge the air through the discharge hole 30. The cooling fan 50 may be attached to the door inner wall 400 to induce the air flow from the first door passage P1 to the second door passage P2. Thus, the suction hole 20 may be defined in an end of the first door passage P1, and the discharge hole 30 may be defined in an end of the second door passage P2.

When the cooling fan 50 is driven, the external air may be introduced into the first door passage P1 corresponding to the inside of the door 4 through the suction hole 20 of the door 4. The external air introduced to the inside of the door 4 through the suction hole 20 may be discharged through the discharge hole 30. The discharge hole 30 may be defined below the suction hole 20 so that the introduced external air is easily discharged.

In some implementations, the microwave oven 2 may include the cooling fan 50, the suction hole 20, and the discharge hole 30 to provide a contamination prevention passage in the door 4, thereby guiding air generated in the cooking appliance 1 through the door 4.

For example, the external air may be suctioned into the first door passage P1 inside of the door 4 through the suction hole 20 and flow downward along the first door passage P1. In some examples, a portion of the air in the first door passage P1 may flow to the second door passage P2 by a first cooling fan 51, and another portion of the air in the first door passage P1 may flow to the second door passage P2 by the second cooling fan 52.

The external air flowing through the second door passage P2 may be discharged to the outside through the first discharge hole 32. The first discharge hole 32 may be defined below the display 40 to guide the discharged air in a direction of the front surface of the door 4. Thus, the first discharge hole 32 may provide a first air passage through which the discharged external air flows in the direction of the front surface of the door 4. The first air passage may be an air passage through which the air suctioned through the suction hole 20 is discharged through the first discharge hole 32. The first air passage may guide the contaminated air to flow upward from the lower side, which may help to prevent or reduce contamination of the door 4.

In some examples, where the air suctioned through the suction hole 20 is discharged through the first discharge hole 32 to pass through the various modules mounted on the door inner wall 400 and the periphery of the display 40, the first air passage may function to cool the modules and the display 40, which are mounted on the door 4, through the circulation of the air. Thus, the microwave oven 2 may include a cooling passage through which the air suctioned through the suction hole 20 is discharged through the first discharge hole 32. In this case, the first air passage may be a contamination prevention passage-combined cooling passage.

In some implementations, the door 4 may further define a second discharge hole 31. The second discharge hole 31 is defined higher than the display 40 to guide the suctioned air toward the display 40. The external air may be suctioned into the first door passage P1 inside of the door 4 through the suction hole 20 and flow downward along the first door passage P1. Here, a portion of the air may flow to the second door passage P2 by the first cooling fan 51, and the air flowing to the second door passage P2 by the first cooling fan 51 may be discharged through the second discharge hole 31. Here, a second air passage through which the air discharged through the second discharge hole 31 flows toward the display 40 may be provided. The second air passage may be an air passage through which the air suctioned through the suction hole 20 is discharged through the second discharge hole 31. The second air passage may help to prevent the contaminated air flowing upward from the lower side from being attached to the display 40 disposed on the door front surface 4*c*. In this case, the second air passage may be a contamination prevention passage.

Thus, the microwave oven 2 may provide the contamination prevention passage.

The door 4 may further include the third discharge hole 33. The third discharge hole 33 may be defined in the bottom surface 4*b* of the door 4 to guide the suctioned air to a lower side of the door 4. When the external air is discharged to the outside through the third discharge hole 33, an air passage may be provided so that the discharged air flows downward vertically. That is, the third air passage may be provided in the door 4 so that the air suctioned through the suction hole 20 flows downward along the first door passage P1 and then is discharged through the third discharge hole 33.

Thus, the microwave oven 2 may provide a passage for securing sight of a camera module mounted around the third discharge hole 33 that will be described below. In this case, the third air passage may be a camera sight securing passage.

In some implementations, a protrusion may be disposed on the door 4.

Next, an example of various shapes of the door 4 to which the door 4 is applied will be described with reference to FIG. 4.

Figure 4:
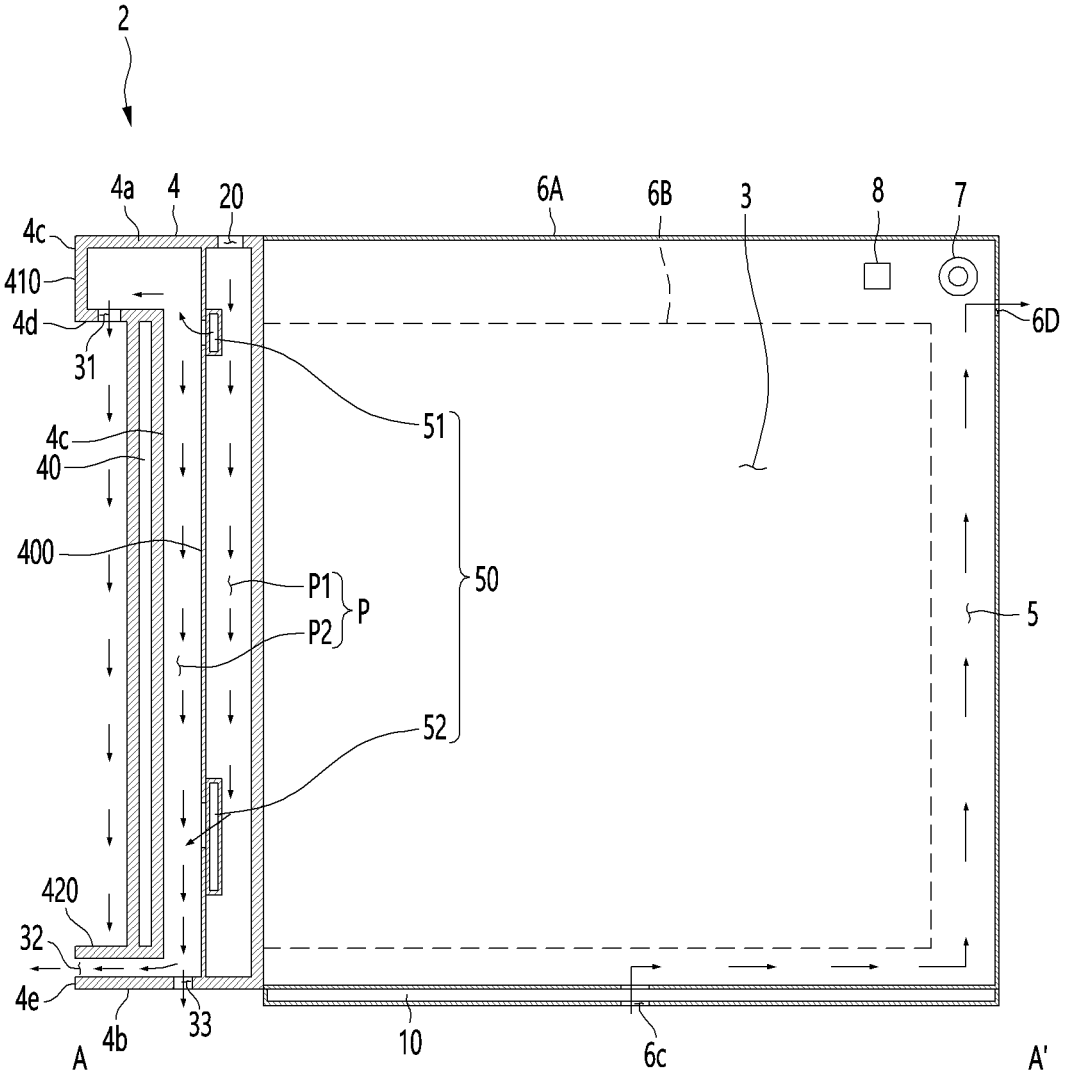
FIG. 4 is a view illustrating an example of a door of the microwave oven.

FIG. 4 is a view illustrating an example of a door of the microwave oven.

In some implementations, the door 4 may include a first protrusion 410 that protrudes from the front surface 4*c* and is disposed on an upper portion of the door 4. In some examples, the second discharge hole 31 may be defined in a bottom surface 4*d* of the first protrusion 410. The external air discharged through the second discharge hole 31 may flow vertically along the display 40 disposed on the front surface 4*c* of the door 4. That is, the first protrusion 410 of the door 4 may guide the discharged external air to flow only downward, thereby improving an effect of blocking the contaminated air that may reach the display 40.

In some implementations, the door 4 may include a second protrusion 420 that protrudes from the front surface 4*c* and is disposed on a lower portion of the door 4. The first discharge hole 32 may be defined in the second protrusion 420. In some examples, the first discharge hole 32 may be defined in a front surface 4*e* of the second protrusion 420. In this case, the second protrusion 420 of the door 4 may guide the discharged external air to flow in the direction of the front direction of the door 4, thereby effectively guiding the contaminated air flowing upward from the lower side to avoid or reduce contamination of the display 40 by the air.

In some examples, the second protrusion 420 itself may help to prevent the contaminated air flowing upward from the lower side from flowing toward the display 40.

The microwave oven 2 may have an insufficient inner space due to the coupling of the exhaust device and the microwave oven when a new device such as the display is coupled. In addition, there is a limitation that heat is generated when the modules of the devices coupled to each other in the insufficient inner space operate.

In the case of mounting the modules, to simultaneously solve the limitations of the insufficient inner space and the heat generation, in the microwave oven 2, various modules may be provided by utilizing the inner space of the door, and also, the cooling passage for cooling the modules may be provided in the door 4.

FIG. 5 is a view illustrating an example of various components of the microwave oven.

For instance, the door 4 may additionally include a camera module 60, a communication module 80, an audio output unit 90, and the like.

In some implementations, the camera module 60, the communication module 80, and the audio output unit 90 may be attached to the door inner wall 400. In some implementations, each module may not be attached to the door inner wall 400 but be disposed inside the door 4. Here, the installed position of the modules, which illustrated in the drawing, do not limit the scope of the present disclosure.

As described above, the external air introduced into the suction hole 20 and then discharged through the discharge hole 30 via the door passage P may cool heat generated when each of the modules operates. That is, the air passage provided in the door 4 may also serve as a cooling passage. At least one of the first to third air passages described above may also serve as the cooling passage.

The arrangement of each module and the arrangement of the discharge hole 30 will be described in detail.

The camera module 60 may include a first camera module 63, a second camera module 62, and a third camera module 61. For example, each camera module may include a camera configured to capture an image or video.

The first camera module 63 may be mounted around the third discharge hole 33 defined in the door bottom surface 4*b* to photograph a lower side of the microwave oven 2. That is, the first camera module 63 may photograph food being cooked in the cooking appliance 1.

The contaminated air generated below the microwave oven 2 may be attached to a lens of the first camera module 63. In this case, the contaminated air may block the field of view of the first camera module 63. However, the air suctioned through the suction hole 20 and discharged through the third discharge hole 33 may help to prevent the contaminated air from being attached to the lens of the first camera module 63. Thus, the third air passage through which the external air is suctioned through the suction hole 20 and discharged through the third discharge hole 33 may mean a passage for securing sight of the camera.

The second camera module 62 may be disposed inside the door 4 to photograph the cavity 3. The second camera module 62 may photograph a process in which food is cooked while the food is cooked in the cavity 3 to provide the photographed image to the user. Thus, the user may observe the inside of the cavity 3.

The third camera module 61 may be disposed on the door front surface 4*c* to photograph a front side of the door 4. This is done for photographing the user located in front of the microwave oven 2 so that the user performs various operations such as making a video call through the device while cooking food.

Next, a method for controlling various modules of the microwave oven 2 will be described with reference to FIG. 6.

Figure 6:
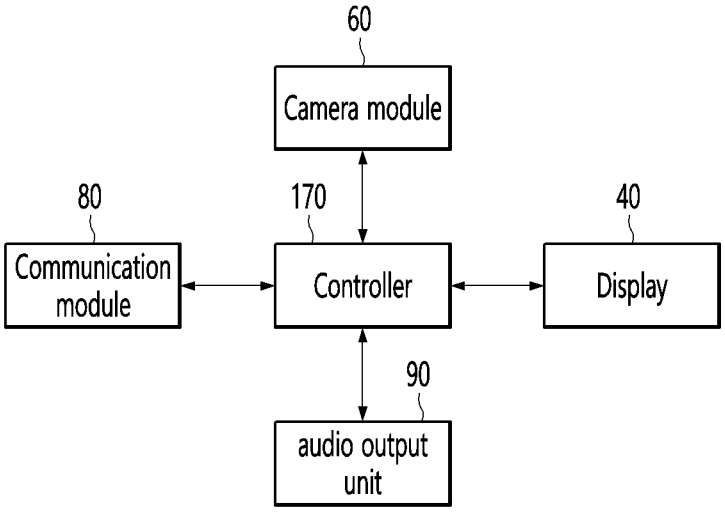
FIG. 6 is a block diagram illustrating an example of a configuration of the microwave oven.

FIG. 6 is a block diagram illustrating an example configuration of the microwave oven.

A controller 170 may control an overall operation of the microwave oven 2. For example, the controller 170 may include an electric circuit, a processor, or the like.

The camera module 60 may include the first camera module 63, the second camera module 62, and the third camera module 61.

The controller 170 may control the communication module 80 to transmit an image photographed through the camera module 60 to an external device.

The controller 170 may control the display 40 to display an image photographed through the camera module 60.

Thus, the user may confirm conditions of food being cooked in the cooking appliance 1 or food being cooked in the cavity 3 through the display 40 and also remotely confirm the conditions of the food.

The communication module 80 may communicate with external devices through wired or wireless communication. The communication module 80 may perform short-range communication or long-range communication with the external devices. For this, the communication module 80 may support the short-range communication or the long-range communication by using at least one of Bluetooth, RFID, infrared communication, UWB, ZigBee, NFC, Wi-Fi, Wi-Fi Direct, or wireless USB technologies. The communication module 80 may include a transmitter, a receiver, or a transceiver. In some cases, the communication module 80 may be a part of the controller 170.

The controller 170 may control the modules to communicate with the external devices through the communication module 80, receive a voice file, a video file, and the like from the external devices so as to output or display the voice file, the video file, and the like through the audio output unit 90 or the display 40.

The user may watch a cooking recipe video, make a video call, etc., through the display 40 while cooking.

The audio output unit 90 may be a device that outputs an audio or sound signal. For example, the audio output unit 90 may include a speaker.

The controller 170 may control the audio output unit 90 to output a sound signal included in a voice file, a video file, and the like, which may be received through the communication module 80.

The above-disclosed subject matter is to be considered illustrative, and not restrictive, and the appended claims are intended to cover all such modifications, enhancements, and other implementations, which fall within the true spirit and scope of the present disclosure.

Thus, the implementation of the present disclosure is to be considered illustrative, and not restrictive, and the technical spirit of the present disclosure is not limited to the foregoing implementation.

Therefore, the scope of the present disclosure is defined not by the detailed description of the disclosure but by the appended claims, and all differences within the scope will be construed as being included in the present disclosure.

What is claimed is:

1. A microwave oven comprising:

a housing that defines a cavity therein;

a heating source configured to heat an object in the cavity;

an exhaust device disposed at a lower portion of the housing;

a door connected to the housing, the door defining a suction hole configured to receive air from an outside of the door and at least one discharge hole configured to discharge the air received through the suction hole; and a display disposed at a front surface of the door, wherein the at least one discharge hole comprises a first discharge hole defined vertically below the display and configured to discharge the air in a forward direction away from the front surface of the door.

2. The microwave oven according to claim 1, further comprising a cooling fan disposed at an inner surface of the door and configured to blow the air toward the at least one discharge hole.

3. The microwave oven according to claim 1, wherein the first discharge hole is defined below the suction hole.

4. The microwave oven according to claim 1, wherein the first discharge hole is configured to discharge the air in the forward direction away from a front surface of the display.

5. The microwave oven according to claim 4, wherein the first discharge hole extends forward from the front surface of the door to the front surface of the display.

6. The microwave oven according to claim 1, wherein the at least one discharge hole further comprises a second discharge hole defined vertically above the display.

7. The microwave oven according to claim 6, wherein the second discharge hole is configured to guide the air toward the display.

8. The microwave oven according to claim 6, wherein the at least one discharge hole further comprises a third discharge hole defined at a bottom surface of the door.

9. The microwave oven according to claim 8, wherein the third discharge hole is configured to guide the air to a lower side of the door.

10. The microwave oven according to claim 9, further comprising a camera disposed around the third discharge hole and configured to photograph a lower side of the housing.

11. The microwave oven according to claim 1, further comprising a camera disposed at an inner surface of the door.

12. The microwave oven according to claim 1, further comprising a camera disposed at the front surface of the door.

13. The microwave oven according to claim 1, wherein the at least one discharge hole comprises at least one of the first discharge hole, a second discharge hole defined vertically above the display, or a third discharge hole defined at a bottom surface of the door.

14. The microwave oven according to claim 13, wherein the door defines at least one of:

a first air passage configured to guide the air from the suction hole to the first discharge hole;

a second air passage configured to guide the air from the suction hole to the second discharge hole; or a third air passage configured to guide the air from the suction hole to the third discharge hole.

15. The microwave oven according to claim 1, wherein the at least one discharge hole comprises the first discharge hole, a second discharge hole vertically above the display, and a third discharge hole at a bottom surface of the door.

16. A microwave oven comprising:

a housing that defines a cavity therein;

a heating source configured to heat an object in the cavity;

an exhaust device disposed at a lower portion of the housing;

a door connected to the housing, the door defining a suction hole configured to receive air and at least one discharge hole configured to discharge the air received through the suction hole;

a door inner wall that extends in a vertical direction and that partitions an inner space of the door into a first door passage in communication with the suction hole and a second door passage in communication with the discharge hole; and a display that is positioned forward relative to the door inner wall and extends in the vertical direction, wherein the at least one discharge hole comprises a first discharge hole defined vertically below the display and configured to discharge the air in a forward direction away from a front surface of the door.

17. The microwave oven according to claim 16, wherein the door inner wall defines a through-hole that connects the first door passage to the second door passage, and wherein the microwave oven further comprises a cooling fan disposed at the through-hole of the door inner wall and configured to supply air from the first door passage to the second door passage.

18. The microwave oven according to claim 16, wherein the suction hole is defined at an upper surface of the door, and wherein the at least one discharge hole further comprises a second discharge hole defined between the upper surface of the door and an upper and of the display.

19. The microwave oven according to claim 16, wherein the first discharge hole is defined at at least one of the front surface of the door that faces the display or a bottom surface of the door that faces the exhaust device.

20. The microwave oven according to claim 16, wherein the first discharge hole is configured to discharge the air in the forward direction away from a front surface of the display.

* * * * *